United States Patent [19]

Brown et al.

[11] Patent Number: 4,749,305

[45] Date of Patent: Jun. 7, 1988

[54] ECCENTRIC-WEIGHT SUBASSEMBLY, AND IN COMBINATION WITH AN EARTH COMPACTOR DRUM

[75] Inventors: Samuel K. Brown, Greencastle; Steve K. Yates, Scotland, both of Pa.

[73] Assignee: Ingersoll-Rand Company, Woodcliff Lake, N.J.

[21] Appl. No.: 90,910

[22] Filed: Aug. 31, 1987

[51] Int. Cl.[4] ..... E01C 19/38

[52] U.S. Cl. ..... 404/117; 404/130; 74/61; 74/87; 366/116; 366/128

[58] Field of Search ..... 404/117, 130; 74/61, 74/87; 366/116, 128; 209/366.5

[56] References Cited

U.S. PATENT DOCUMENTS

| | | | |
|---|---|---|---|
| 3,026,781 | 3/1962 | Schafer | 404/117 |
| 3,670,631 | 6/1972 | Gaylord | 404/117 |
| 3,892,496 | 7/1975 | Martinez | 404/117 |
| 4,176,983 | 12/1979 | Gardner | 404/117 |
| 4,195,947 | 4/1980 | Lambertz | 404/117 |
| 4,262,549 | 4/1981 | Schwellenbach | 74/87 |
| 4,353,261 | 10/1982 | Salani | 404/117 X |
| 4,412,757 | 11/1983 | Kümmel et al. | 74/87 X |
| 4,454,780 | 6/1984 | Goehler et al. | 404/117 X |
| 4,561,319 | 12/1985 | Lilja | 404/117 X |
| 4,568,218 | 2/1986 | Orzal | 404/117 |

FOREIGN PATENT DOCUMENTS

| | | | |
|---|---|---|---|
| 2633578 | 2/1977 | Fed. Rep. of Germany | 404/117 |
| 1146454 | 11/1957 | France | 404/117 |

*Primary Examiner*—Stephen J. Novosad
*Assistant Examiner*—John F. Letchford
*Attorney, Agent, or Firm*—B. J. Murphy

[57] ABSTRACT

The subassembly comprises a shaft having an eccentrically-weighted portion journalled in a tube which also has an eccentrically-weighted portion. The tube has an abutment therein which prevents full rotation of the tube relative to the shaft. With rotation of the tube in one direction, its abutment, at one side, comes into engagement with the eccentrically-weighted portion of the shaft and, consequently, both portions are in proximity and radially aligned to produce a maximum, oscillatory vibration. Tube rotation in the opposite direction causes the shaft portion to engage the other side of the abutment and, consequently, the portions are in opposite, radial dispositions, and produce a minimum, oscillatory vibration.

13 Claims, 2 Drawing Sheets

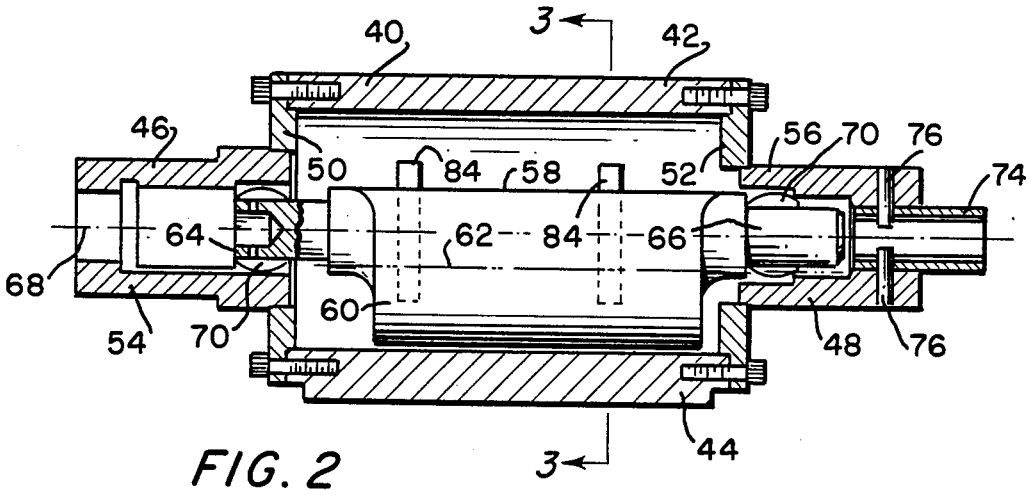
FIG. 2
FIG. 3
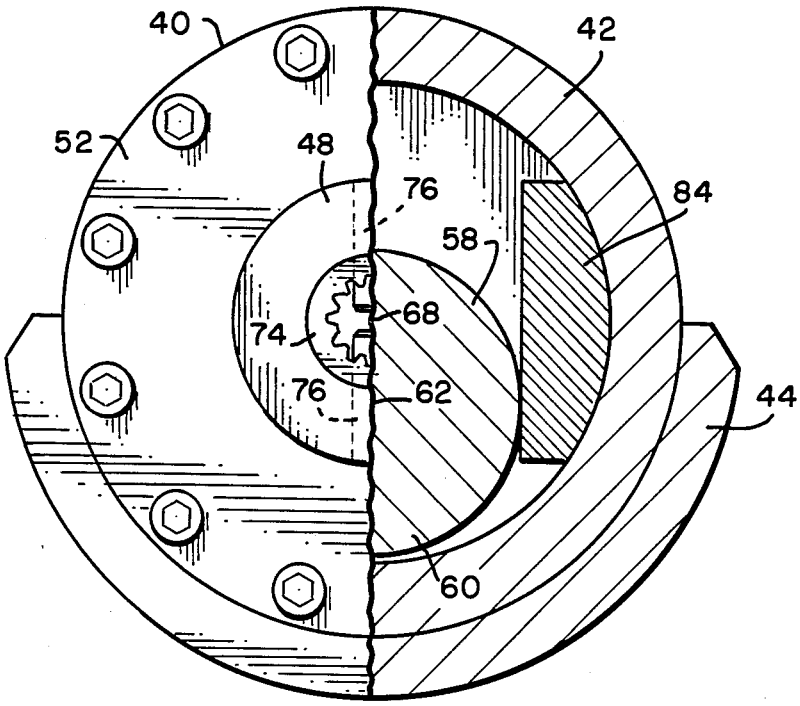

ECCENTRIC-WEIGHT SUBASSEMBLY, AND IN COMBINATION WITH AN EARTH COMPACTOR DRUM

This invention pertains to vibratory mechanisms having eccentrically-weighted subassemblies, useful especially in earth compactor drums, and to such subassemblies per se, and to such mechanisms in combination with earth compactor drums.

Inventions of the aforesaid type are known in the prior art, and typical thereof is the Vibratory Mechanism of U.S. Pat. No. 4,454,780, issued 19 June, 1984, to Goehler, et al.

In the aforesaid patent, the mechanism, designed especially for use in an earth compacting drum, comprises a pair of concentrically-arranged, eccentrically-weighted elements, which are rotated in unison by means of a hydraulic motor. The mechanism is housed within an earth compacting drum, and the one eccentrically-weighted element is translatable, axially, and disengageable from a splined coupling, in order that it may be indexed to different rotary positions relative to the other eccentrically-weighted element. In this manner, vibratory amplitudes may be increased or decreased.

The aforesaid, patented Mechanism is quite efficient and novel, and offers the user a multiplicity of vibratory amplitudes from which to choose. However, commonly the operator of an earth compactor requires only a maximum vibratory amplitude or a minimum vibratory amplitude. Requiring only these two modes of operation, the Mechanism of U.S. Pat. No. 4,454,780 is more complex (and expensive of manufacture) than necessary. What has been needed, for a maximum-or-minimum vibratory amplitude, is a less complex unit, and one less expensive to fabricate.

It is an object of this invention, then, to disclose just such an uncomplicated and relatively inexpensive unit.

It is particularly an object of this invention to set forth an eccentric-weight subassembly, for a vibratory mechanism useful in an earth compactor drum, comprising a tube having an inner, wall surface; said tube having an eccentrically-weighted portion; said tube further having housings at opposite ends thereof; a shaft having an eccentrically-weighted portion on an outer surface thereof; said shaft further having stubs, at opposite ends thereof, confined within said housings; and bearing means, interposed between said stubs and said housings, for accommodating relative rotation between said tube and shaft; wherein one of said housings has coupling means, engageable by a prime mover, for rotating said housings and tube in clockwise and counterclockwise directions; and further including means interpositioned between said inner and outer surfaces for limiting said relative rotation between said tube and said shaft, in each of said directions, to less than three hundred and sixty degrees of arc.

It is a further object of this invention to set forth, in combination with an earth compactor drum, a vibratory mechanism having an eccentric-weight subassembly, comprising a drum; said drum having a cylindrical chamber formed therein; said chamber having end walls; and a tube having an inner, wall surface; wherein said tube has an eccentrically-weighted portion; said tube further has housings at opposite ends thereof; said housings are journalled in said end walls; and further including a shaft having an eccentrically-weighted portion on an outer surface thereof; said shaft further having stubs, at opposite ends thereof, confined within said housings; and bearing means, interposed between said stubs and said housings, for accommodating relative rotation between said tube and shaft; wherein one of said housings has coupling means, engageable by a prime mover, for rotating said housings and tube in clockwise and counterclockwise directions; and further including means interpositioned between said inner and outer surfaces for limiting said relative rotation between said tube and said shaft, in each of said directions, to less than three hundred and sixty degrees of arc.

Further objects of this invention, as well as the novel features thereof, will become more apparent by reference to the following description taken in conjunction with the accompanying figures, in which:

FIG. 2 is a cross-sectional view of just the eccentric-weight subassembly, according to the invention; and FIG. 3 is a composite illustration. The left half of FIG. 3 is an end view of the subassembly of FIG. 2, taken from the right-hand side of FIG. 2, and the right half of FIG. 3 is a cross-sectional view taken along section 3—3 of FIG. 2.

Figure 1:
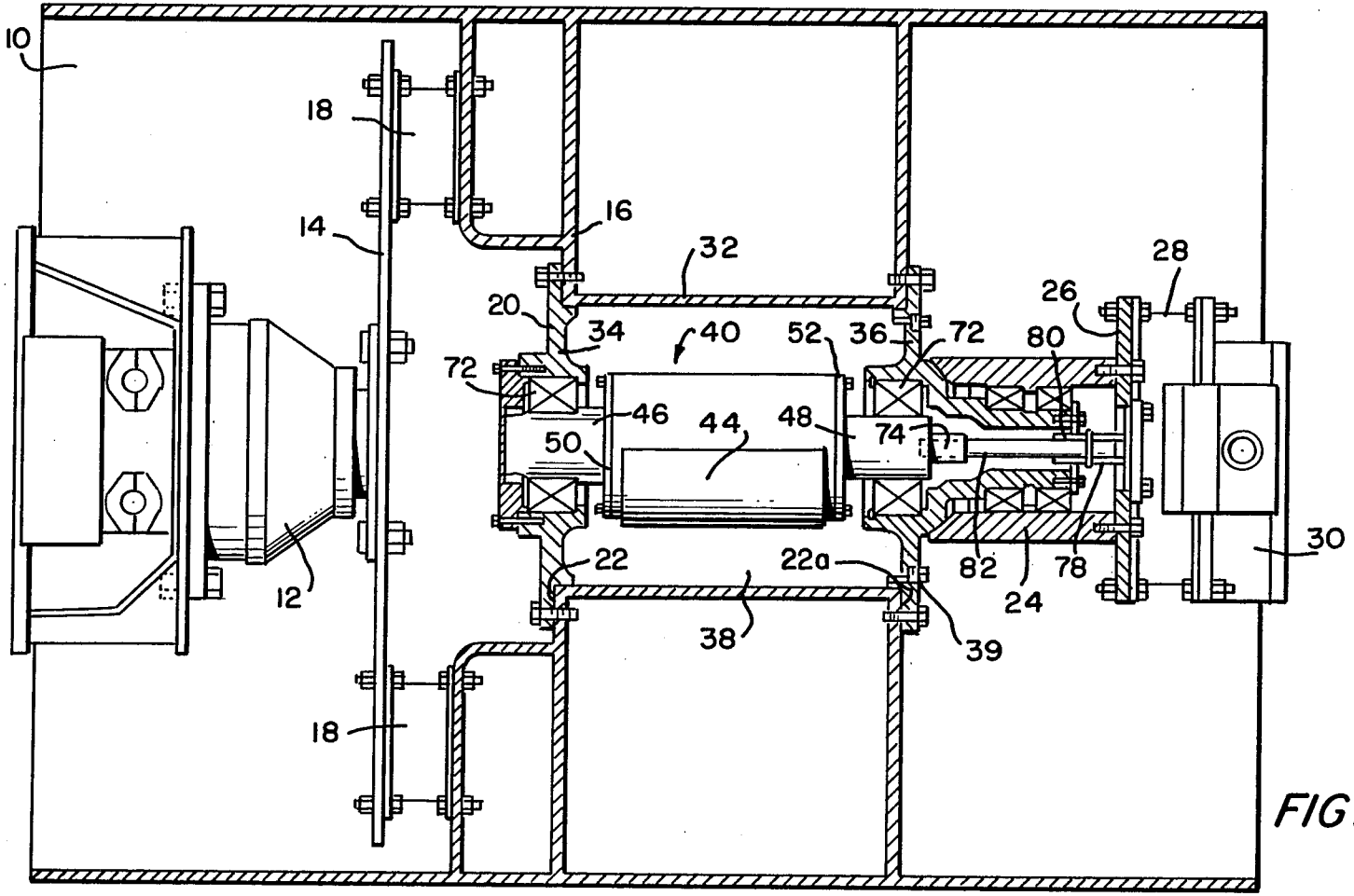
FIG. 1 is a cross-sectional view of an earth compactor drum having an embodiment of the novel vibratory mechanism and the eccentric-weight subassembly incorporated therein.

As shown in the figures, an earth compactor drum 10 has a drum-driving, torque hub assembly 12 coupled thereto through a mounting plate 14. Plate 14 is joined to a channeled weldment 16 through elastomeric shock absorbers 18.

A bearing housing 20 is bolted to an inner, annular shoulder 22 of the weldment 16. To a corresponding shoulder **22*a* of the Weldment 16 there is fastened one end of a carrier subassembly 24. To the opposite end of the subassembly 24 is secured a shock mounting plate 26. A carrier weldment and shock absorber assembly 28 is fastened to the mounting plate 26, and a vibratory motor subassembly 30 is fastened to the assembly 28**.

Weldment 16 comprises a cylindrical shell 32, and shell 32 cooperates with plates 34 and 36 of bearing housing 20 and carrier subassembly 24, respectively, to define a cylindrical chamber 38. An eccentric-weight subassembly 40 is confined within chamber 38. A threaded plug 39 in plate 36 is used to admit oil into chamber 38 for lubricator purposes; accordingly seals are interpositioned between shoulders 22, and **22*a* and plates 34, 36**.

Subassembly 40 comprises a tube 42 which has an eccentrically-weighted portion 44. Portion 44 is an external, prominent land which subtends an arc of one hundred and eighty degrees. Bolted to opposite ends of the tube 42 are journal housings 46 and 48. The housings comprise end plates 50 and 52 and hollow shafts 54 and 56. Confined within the tube 42 is a shaft 58 which has an eccentrically-weighted portion 60. Actually, shaft 58 comprises: (a) a straight, cylindrical element, having a given, axial centerline 62, and (b) stubs 64 and 66 which have a common, rotary axis 68 which is offset from, albeit parallel with, centerline 62.

Stubs 64 and 66 are mounted in bearings 70 which are, in turn, mounted in the journal housings 46 and 48. The journal housings 46 and 48 are themselves journalled in plates 34 and 36 through bearings 72. Shaft 58 is supported within the tube 42 in only a freely-journalled disposition; the aforesaid housings 46 and 48, stubs 64 and 66, and bearings 70, as can be seen in FIG.

2, cooperate to so support the shaft in its freely-journalled disposition.

Hollow shaft 56 of housing 48 has a splined coupling 74 received therein, and extending therefrom. Shaft 56 and coupling 74 have common pin holes formed therein, and aligned to receive shear pins 76. Accordingly, coupling 74, housings 46 and 48 and tube 42 rotate in common.

Vibratory motor subassembly 30 has a power shaft 78 extending therefrom to which is pinned a splined coupling 80. A splined shaft 82 interconnects the couplings 74 and 80, so that rotary drive from subassembly 30 will rotate housings 46 and 48, and tube 42.

Within tube 42, and fixed to the inner wall thereof, are a pair of abutments 84. The abutments 84 obstruct or prevent a relative rotation, between shaft 58 and tube 42, beyond one hundred and eighty degrees of arc. Accordingly, as shown in FIG. 3, rotation of the tube 42 in the clockwise direction will retain the common radial alignment and juxtapositioning of portions 44 and 60 shown there. However, rotation in the counterclockwise direction will carry the tube through one hundred and eighty degrees of arc, and dispose the abutments 84 on the left-hand side to where they encounter the portion 60 (preventing further, relative rotation). Additionally, portions 60 and 44 will then be at radially opposite dispositions, and remote from each other. In the former circumstance, i.e., the condition shown in FIG. 3, the subassembly 40, rotated by the subassembly 30 in a continuing clockwise direction, will produce a maximum, oscillatory vibration to the drum 10. In the latter circumstance, where subassembly 30 drives the subassembly 40 in the counterclockwise direction, a minimum, oscillatory vibration will be imparted to the drum 10. Hence, it is necessary merely to reverse the rotary drive of subassembly 30 to switch the vibration between maximum and minimum modes.

While We have described our invention in connection with a specific embodiment thereof, it is to be clearly understood that this is done only by way of example, and not as a limitation to the scope of our invention as set forth in the objects thereof and in the appended claims.

We claim:

1. An eccentric-weight subassembly, for a vibratory mechanism useful in an earth compactor drum, comprising:

a tube having an inner, wall surface;

said tube having an eccentrically-weighted portion;

said tube further having housings at opposite ends thereof;

a shaft having an eccentrically-weighted portion on an outer surface thereof;

said shaft further having stubs, at opposite ends thereof, confined within said housings; and bearing means, interposed between said stubs and said housings, for accommodating relative rotation between said tube and shaft; wherein said shaft is supported within said tube in only a freely-journalled disposition, and said housings, stubs, and bearing means comprise means cooperative for so supporting said shaft, within said tube, in said disposition;

one of said housings has coupling means, engageable by a prime mover, for rotating said housings and tube in clockwise and counterclockwise directions; and further including means interpositioned between said inner and outer surfaces for limiting said relative rotation between said tube and said shaft, in each of said directions, to less than three hundred and sixty degrees of arc.

2. An eccentric-weight subassembly, according to claim 1, wherein:

said rotation limiting means comprises means for limiting said relative rotation, as aforesaid, to approximately one hundred and eighty degrees of arc, to effect (a) juxtapositioning and common radial alignment of said portions, pursuant to rotation of said housings and tube in one of said directions, whereby a maximum, oscillatory vibration is producible by said portions as a consequence of such juxtapositioning and radial alignment, and (b) radial opposition and remoteness of said portions relative to each other, pursuant to rotation of said housings and tube in the other of said directions, whereby each one of said portions counteracts and attenuates oscillatory vibrations producible by the other of said portions.

3. An eccentric-weight subassembly, according to claim 1, wherein:

said portion of said tube comprises a prominent, arcuate land subtending an arc of approximately one hundred and eighty degrees.

4. An eccentric-weight subassembly, according to claim 1, wherein:

said shaft comprises a straight, cylindrical portion having a given, axial centerline; and said stubs have a common, rotary axis offset from, and parallel with, said centerline.

5. An eccentric-weight subassembly, according to claim 1, wherein:

said rotation limiting means comprises an abutment; and said abutment is mounted to said wall surface.

6. An eccentric-weight subassembly, according to claim 1, wherein:

said one housing includes a splined coupling projecting therefrom, and said coupling comprises the aforesaid prime mover engaging means.

7. In combination with an earth compactor drum, a vibratory mechanism having an eccentric-weight subassembly, comprising:

a drum;

said drum having a cylindrical chamber formed therein;

said chamber having end walls; and a tube having an inner, wall surface; wherein said tube has an eccentrically-weighted portion;

said tube further has housings at opposite ends thereof;

said housings are journalled in said end walls; and further including;

a shaft having an eccentrically-weighted portion on an outer surface thereof;

said shaft further having stubs, at opposite ends thereof, confined within said housings; and bearing means, interposed between said stubs and said housings, for accomodating relative rotation between said tube and shaft; wherein said shaft is supported within said tube in only a freely-journalled disposition, and said housings, stubs, and bearing means comprise means cooperative for so supporting said shaft, within said tube, in said disposition;

one of said housings has coupling means, engageable by a prime mover, for rotating said housings and tube in clockwise and counterclockwise directions; and further including means interpositioned between said inner and outer surfaces for limiting said relative rotation between said tube and said shaft, in each of said directions, to less than three hundred and sixty degrees of arc.

8. The combination, according to claim 7, wherein:

said rotation limiting means comprises means for limiting said relative rotation, as aforesaid, to approximately one hundred and eighty degrees of arc, to effect (a) juxtapositioning and common radial alignment of said portions, pursuant to rotation of said housings and tube in one of said directions, whereby a maximum, oscillatory vibration is producible by said portions as a consequence of such juxtapositioning and radial alignment, and (b) radial opposition and remoteness of said portions relative to each other, pursuant to rotation of said housings and tube in the other of said directions, whereby each one of said portions counteracts and attenuates oscillatory vibrations producible by the other of said portions.

9. The combination, according to claim 7, wherein:

said portion of said tube comprises a prominent, arcuate land subtending an arc of approximately one hundred and eighty degrees.

10. The combination, according to claim 7, wherein:

said shaft comprises a straight, cylindrical portion having a given, axial centerline; and said stubs have a common, rotary axis offset from, and parallel with, said centerline.

11. The combination, according to claim 7, wherein:

said rotation limiting means comprises an abutment; and said abutment is mounted to said wall surface.

12. The combination, according to claim 7, wherein:

said one housing includes a splined coupling projecting therefrom, and said coupling comprises the aforesaid prime mover engaging means.

13. The combination, according to claim 7, wherein:

said chamber has a cylindrical shell; and said end walls are fastened to said shell; and further including sealing means, interpositioned between said shell and said end walls, for sealing said chamber against fluid leakage therefrom;

bearings set in said end walls, and about said housings; and means, in one of said end walls, for sealingly admitting lubricant into said chamber for lubrication of said bearings.

* * * * *